US012225989B1

(12) United States Patent
Zhao et al.

(10) Patent No.: US 12,225,989 B1
(45) Date of Patent: Feb. 18, 2025

(54) OUTDOOR ROMAN UMBRELLA WITH UMBRELLA OPENING AND CLOSING STRUCTURE

(71) Applicant: ZHEJIANG LINYA CO., LTD., Zhejiang (CN)

(72) Inventors: Niangao Zhao, Zhejiang (CN); Zhizhong Wu, Zhejiang (CN); Zhiping Wang, Zhejiang (CN)

(73) Assignee: ZHEJIANG LINYA CO., LTD., Zhejiang (CN)

( * ) Notice: Subject to any disclaimer, the term of this patent is extended or adjusted under 35 U.S.C. 154(b) by 0 days.

(21) Appl. No.: 18/808,087

(22) Filed: Aug. 19, 2024

(30) Foreign Application Priority Data

Jul. 30, 2024 (CN) ..... 202421824757.8

(51) Int. Cl.
*A45B 23/00* (2006.01)
*A45B 25/14* (2006.01)

(52) U.S. Cl.
CPC ..... *A45B 23/00* (2013.01); *A45B 25/14* (2013.01); *A45B 2023/0037* (2013.01)

(58) Field of Classification Search
CPC ..... A45B 2023/0037; A45B 2023/005; A45B 2023/0068; A45B 2023/0081; A45B 2023/0056
See application file for complete search history.

(56) References Cited

U.S. PATENT DOCUMENTS

| | | | | |
|---|---|---|---|---|
| 5,960,806 | A * | 10/1999 | Steiner | A45B 25/14 135/21 |
| 6,588,438 | B1 * | 7/2003 | Steiner | A45B 25/06 135/21 |
| 8,104,492 | B2 | 1/2012 | Dan | |
| 9,220,325 | B2 * | 12/2015 | Ma | A45B 23/00 |
| 10,925,362 | B1 * | 2/2021 | Luo | A45B 25/08 |
| 11,122,872 | B2 * | 9/2021 | He | A45B 23/00 |
| 11,375,782 | B2 * | 7/2022 | Yang | A45B 23/00 |
| 11,519,193 | B2 * | 12/2022 | Ma | A45B 23/00 |
| 11,523,664 | B2 * | 12/2022 | Fisher | A45B 25/14 |
| 2010/0051074 | A1 * | 3/2010 | Dan | A45B 23/00 135/20.3 |
| 2013/0092200 | A1 * | 4/2013 | May | A45B 23/00 135/20.1 |
| 2022/0279904 | A1 * | 9/2022 | He | A45B 23/00 |
| 2023/0371663 | A1 * | 11/2023 | Luo | A45B 17/00 |

* cited by examiner

*Primary Examiner* — Noah Chandler Hawk
(74) *Attorney, Agent, or Firm* — JCIPRNET

(57) ABSTRACT

An outdoor Roman umbrella with an umbrella opening and closing structure includes an umbrella post and an umbrella body, where the umbrella post is provided with a slider assembly that moves up and down along the umbrella post, the slider assembly is hinged and matched with a cantilever, and the other end of the cantilever is configured to be matched with the umbrella body. The outdoor Roman umbrella further includes a diagonal draw bar assembly, where when the diagonal draw bar assembly is in a straight-bar state, the diagonal draw bar assembly and the cantilever are matched in a crossed manner, and with the slider assembly moving upward, the diagonal draw bar assembly and the cantilever are deformed in a crossed manner and the umbrella body is driven to be opened.

13 Claims, 9 Drawing Sheets

OUTDOOR ROMAN UMBRELLA WITH UMBRELLA OPENING AND CLOSING STRUCTURE

CROSS-REFERENCE TO RELATED APPLICATION

This application claims the priority benefit of China application serial no. 202421824757.8, filed on Jul. 30, 2024. The entirety of the above-mentioned patent application is hereby incorporated by reference herein and made a part of this specification.

BACKGROUND

Technical Field

The disclosure relates to the technical field of Roman umbrellas, and in particular to an outdoor Roman umbrella with an umbrella opening and closing structure.

Description of Related Art

With the continuous improvement of outdoor life of people, people use outdoor umbrellas more and more. An area under a Roman umbrella is wide, so that there are also more users of the Roman umbrella. The Roman umbrella is formed mainly by arranging a stand post vertically, fixing an umbrella frame of the Roman umbrella to the ground and connecting a rocker handle capable of controlling the Roman umbrella to be opened and closed to the stand post, where the rocker handle is usually slidably connected to the stand post of the Roman umbrella.

An umbrella opening structure of an existing Roman umbrella is usually as described in US publication of U.S. Pat. No. 8,104,492B2. The opening and closing of an umbrella surface of the outdoor umbrella with this structure usually requires rotating operation of a rocker handle, and the opening and closing of the umbrella surface is realized by the winding and unwinding of an umbrella rope. However, a winding degree of the umbrella rope directly affects the opening and closing stability of the umbrella surface, and its operation is relatively complicated.

In the above-mentioned structure, the opening and closing of an umbrella body is realized by unwinding and winding of the umbrella rope; because the umbrella rope has certain ductility, the umbrella body of the umbrella has general wind resistance after opening, and its shaking is relatively large.

SUMMARY

The disclosure aims to provide an outdoor Roman umbrella with an umbrella opening and closing structure.

An outdoor Roman umbrella with an umbrella opening and closing structure, including an umbrella post and an umbrella body, where the umbrella post is provided with a slider assembly that moves up and down along the umbrella post, the slider assembly is hinged and matched with a cantilever, and the other end of the cantilever is configured to be matched with the umbrella body. The outdoor Roman umbrella further includes a diagonal draw bar assembly, where the diagonal draw bar assembly includes a first diagonal draw bar unit, a second diagonal draw bar unit, and a receiving seat, one end of the first diagonal draw bar unit is hinged and matched with the cantilever, the receiving seat is hinged and matched with the cantilever, one end of the second diagonal draw bar unit is fixedly matched with the receiving seat, the other end of the second diagonal draw bar unit is configured to be mounted with the umbrella body in a matched manner, the receiving seat is provided with a limiting part, and the first diagonal draw bar unit is capable of being folded unidirectionally relative to the second diagonal draw bar unit; when the diagonal draw bar assembly is in a straight-bar state, the diagonal draw bar assembly and the cantilever are matched in a crossed manner, and with the slider assembly moving upward, the diagonal draw bar assembly and the cantilever are deformed in a crossed manner and the umbrella body is driven to be opened; and the umbrella body is internally provided with a locking mechanism, and when the umbrella body is completely opened, the locking mechanism completes locking, so that the umbrella body is in an open state all the time, and with the sliding assembly moving along the umbrella post, an angle of the umbrella body is driven to be adjusted.

The first diagonal draw bar unit includes two first diagonal draw bar bodies arranged in parallel at an interval, the receiving seat includes two receiving seat units, the two receiving seat units are respectively disposed on two sides of the cantilever, the other end of a single first diagonal draw bar body is hinged and matched with the corresponding receiving seat unit, the second diagonal draw bar unit includes two second diagonal draw bar bodies arranged in parallel at an interval, and an end of a single second diagonal draw bar body is configured to be mounted with the corresponding receiving seat unit in a matched manner.

The receiving seat unit is internally provided with an embedding groove, the limiting part is disposed at a bottom of the embedding groove, an end of the first diagonal draw bar body is hinged and matched with two side walls of the embedding groove through a hinge shaft and the first diagonal draw bar body is able to be flexibly folded along an opening direction of the embedding groove.

One end of the second diagonal draw bar body is partially embedded into the embedding groove, and is fixedly mounted with the side walls of the embedding groove through a fastener; one end of each of the two first diagonal draw bar bodies is hinged and matched with a top seat separately, the top seat is disposed at a top end of the umbrella post, one end of the cantilever is configured to be hinged and matched with an upper umbrella disc, and the other ends of the two second diagonal draw bar bodies are configured to be hinged and matched with a lower umbrella disc.

The outdoor Roman umbrella further includes an auxiliary driving member, where one end of the auxiliary driving member is hinged on the umbrella post through a first mounting seat, and the other end thereof is hinged and matched with the first diagonal draw bar unit through a second mounting seat.

The locking mechanism includes an operating member, a locking pull rope, a first locking member, and a second locking member, one end of the locking pull rope is matched with the operating member and the other end thereof is matched with the first locking member; and when the first locking member is locked with the second locking member, the locking pull rope is driven by operating the operating member, and the locking pull rope drives the first locking member to move to be separated from the second locking member, so that the locking mechanism is unlocked.

One end of the cantilever is hinged and matched with the upper umbrella disc through a cantilever joint sleeve, the first locking member is mounted in the upper umbrella disc or the cantilever joint sleeve, the first locking member includes a lock rope part, a hinge part, and a hook part, the hinge part is configured to be hinged and matched with the upper umbrella disc or the cantilever joint sleeve and is provided with a reset spring, the lock rope part is configured to be fixedly matched with the locking pull rope, and the hinge part is configured to be hooked and locked with the second locking member.

The upper umbrella disc or the cantilever joint sleeve is provided with an accommodating cavity, the first locking member is located in the accommodating cavity, and a position locking hole is formed in a bottom of the accommodating cavity.

The second locking member includes a lock hook part and a connecting rod, the lock hook part is located at an end of the connecting rod, and the connecting rod extends downwards to be fixedly matched with the lower umbrella disc; and when the umbrella body is opened, the lock hook part enters along the position locking hole and is hooked and locked with the hook part.

The operating member is disposed on the cantilever or the slider assembly or the umbrella post.

The slider assembly includes a sliding seat, a cantilever hinged seat and a slider locking member, the umbrella post is provided with a sliding groove, the sliding seat is configured to be matched with the sliding groove and can move up and down along the sliding groove, the cantilever hinged seat is located at an upper part of the sliding seat, the cantilever hinged seat is configured to be hinged and matched with an end of the cantilever, and the slider locking member is used for enabling the sliding assembly to stop at any height of the umbrella post.

The slider locking member includes a handle, a trigger and a lock pin, and lock teeth or lock catches configured to be locked with the lock pin are disposed in the sliding groove.

The outdoor Roman umbrella further includes a rotating base, and a bottom of the umbrella post is configured to be matched with the rotating base, and can be horizontally rotated by the rotating base.

The rotating base includes a rotating base body and a foot tube, the foot tube is sleeved with the umbrella post, a handwheel locking member is disposed between the umbrella post and the foot tube, and the umbrella post can rotate with the foot tube.

A lower part of the rotating base is matched with a counterweight base.

DESCRIPTION OF THE EMBODIMENTS

In order to make the technical means, the creation characteristics, the achievement purposes and the effects of the disclosure easy to understand, the disclosure is further explained in combination with attached drawings.

Figure 1:
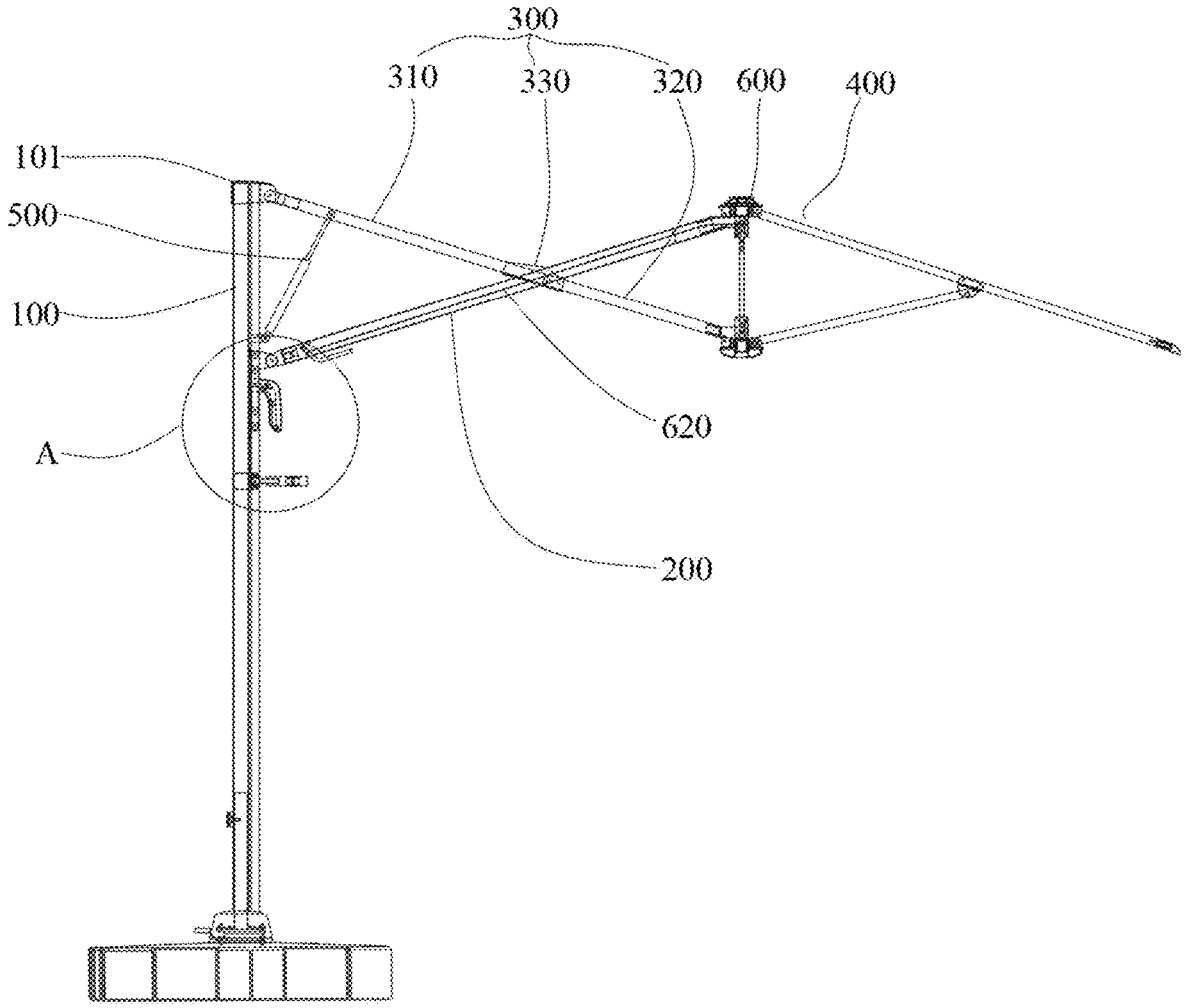
FIG. 1 is a first schematic diagram of an overall structure of the disclosure.
Figure 2:
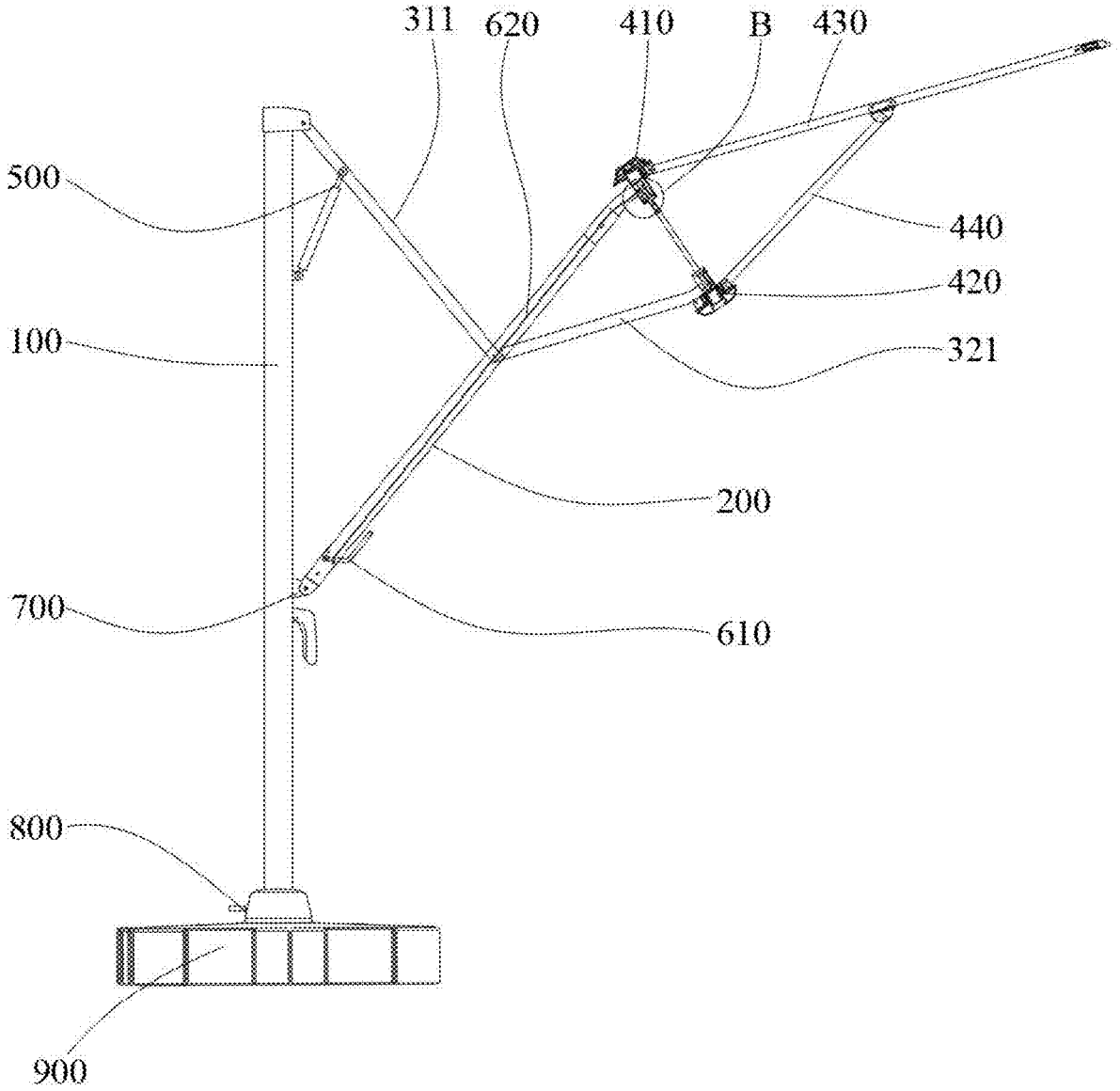
FIG. 2 is a second schematic diagram of the overall structure of the disclosure.
Figure 3:
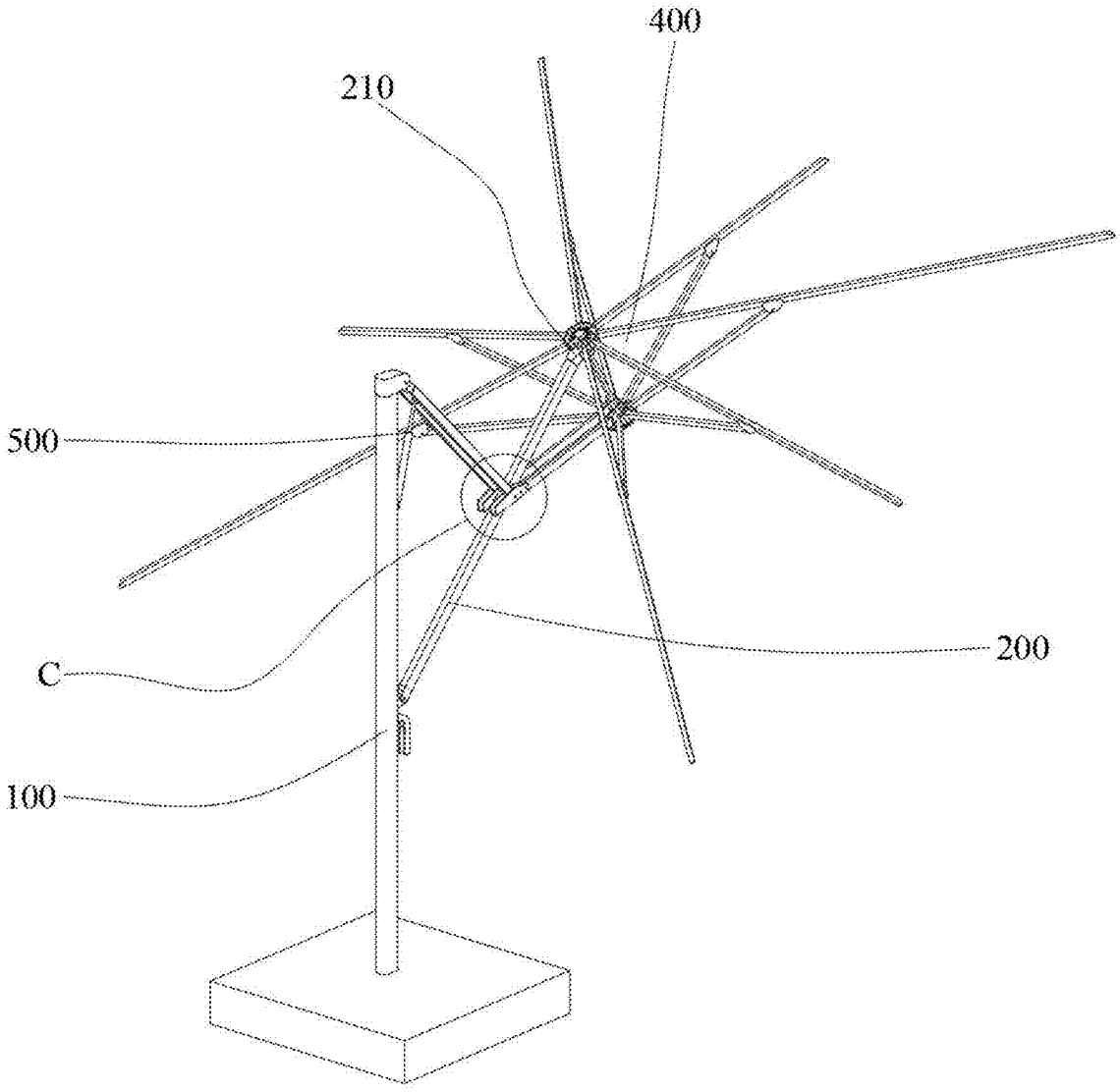
FIG. 3 is a third schematic diagram of the overall structure of the disclosure.
Figure 4:
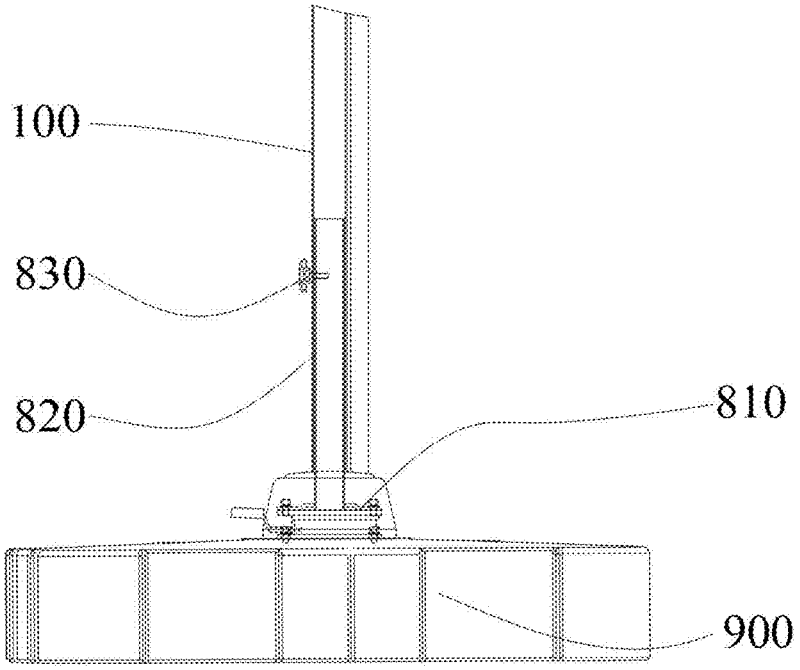
FIG. 4 is a structural schematic diagram showing that a rotating base and a counterweight base of the disclosure are mounted in a matched manner.
Figure 5:
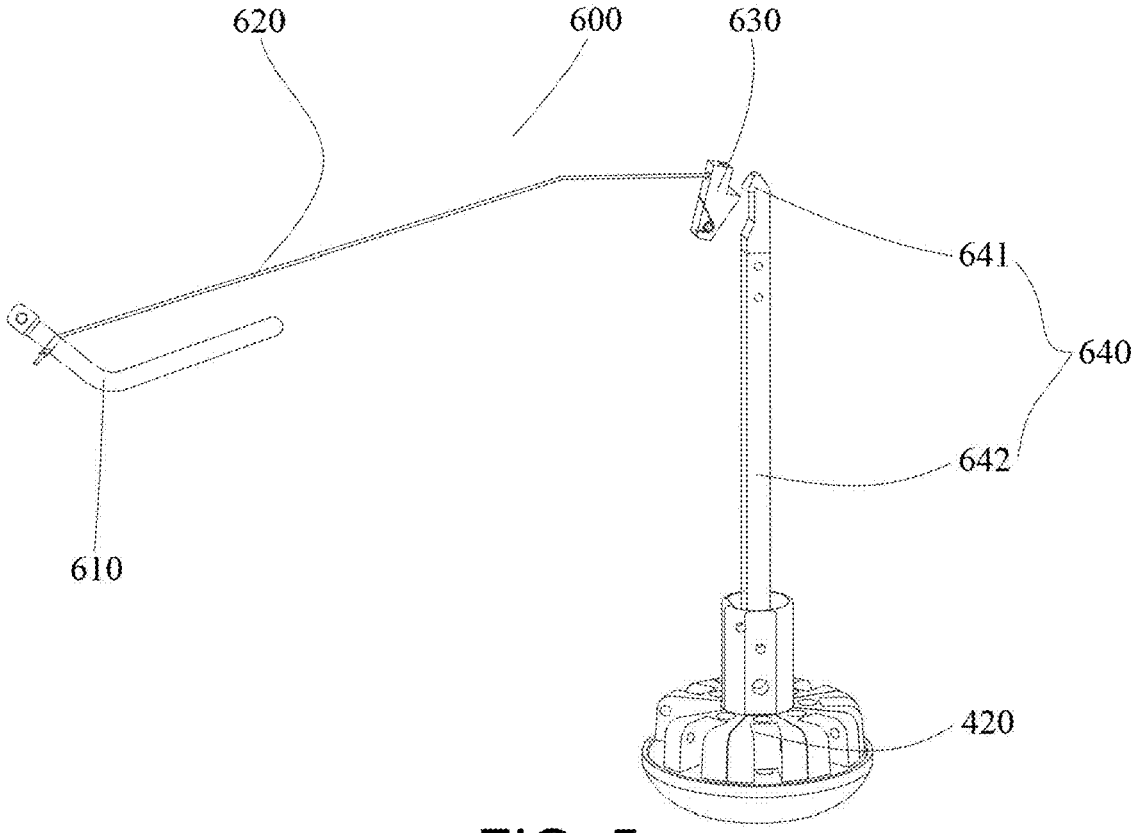
FIG. 5 is a structural schematic diagram of a locking mechanism of the disclosure.
Figure 6:
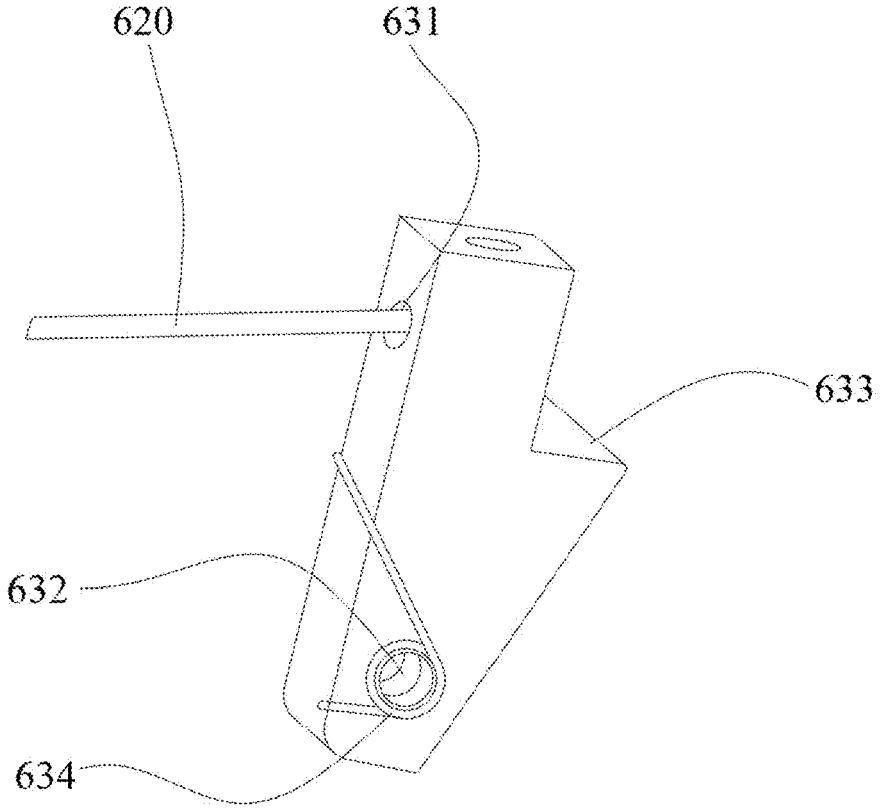
FIG. 6 is a structural schematic diagram of a first locking member of the disclosure.
Figure 7:
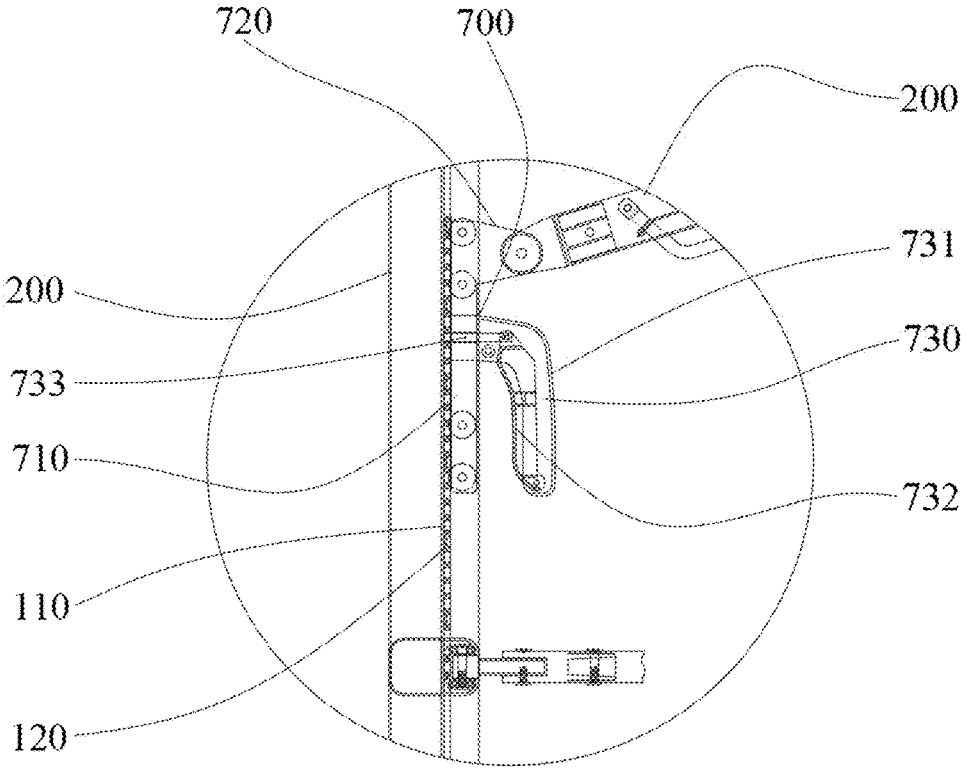
FIG. 7 is a partially enlarged structural schematic diagram of a part A in FIG. 1.
Figure 8:
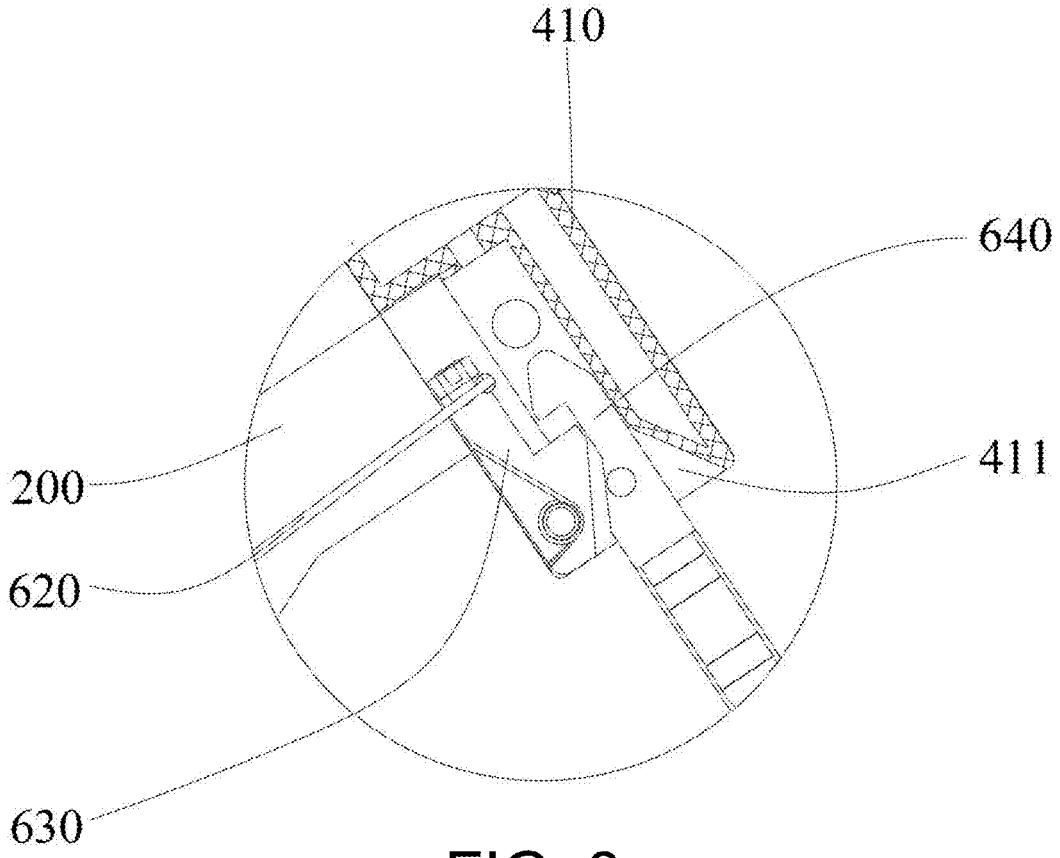
FIG. 8 is a partially enlarged structural schematic diagram of a part B in FIG. 2.
Figure 9:
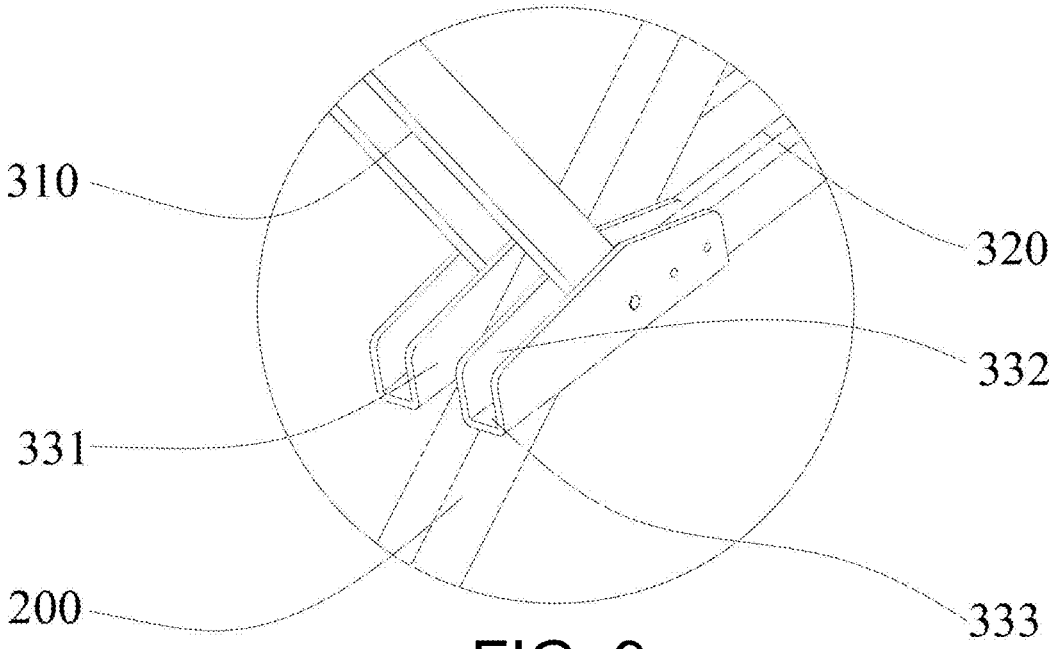
FIG. 9 is a partially enlarged structural schematic diagram of a part C in FIG. 3.
Figure 10:
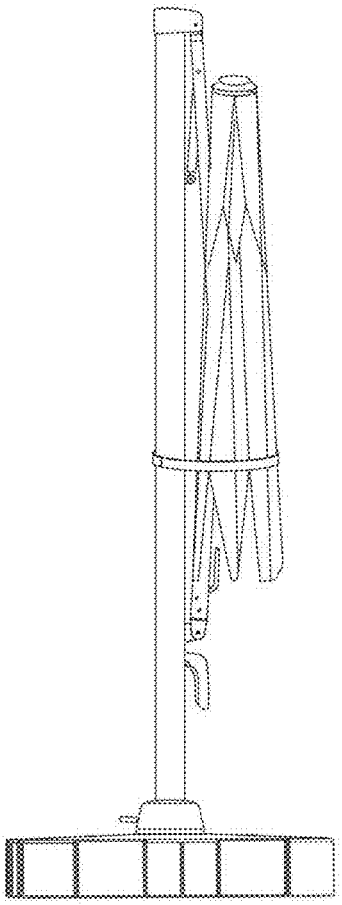
FIG. 10 is a structural schematic diagram of a whole umbrella in a folded state of the disclosure.
Figure 11:
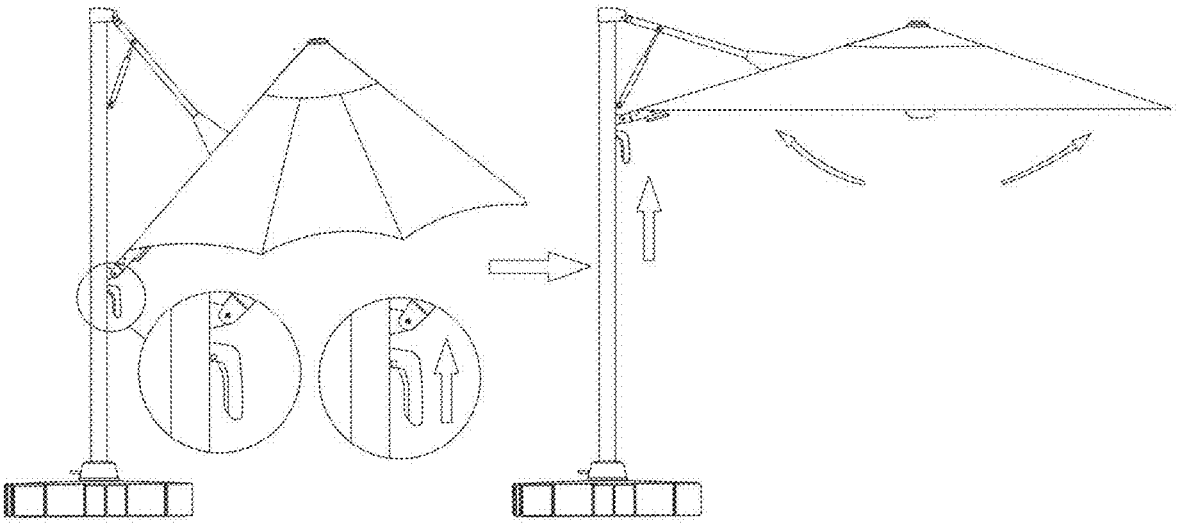
FIG. 11 is a schematic diagram of the whole umbrella of the disclosure changing from a folded state to an open state.
Figure 12:
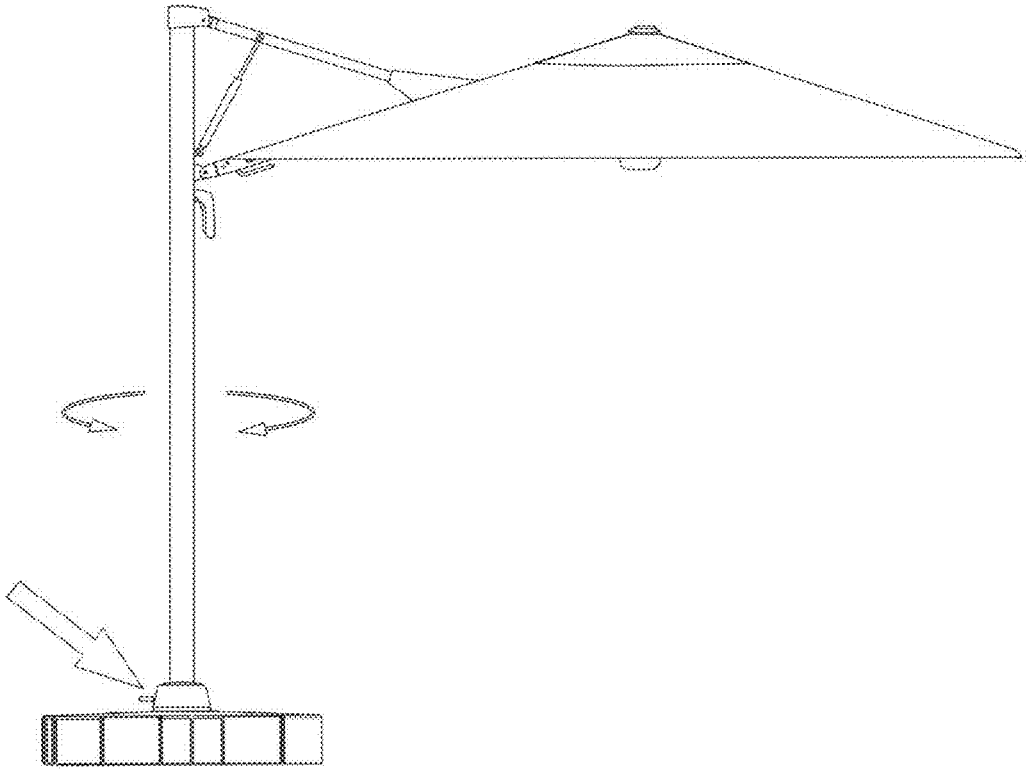
FIG. 12 is a schematic diagram of a horizontal rotating change of the whole umbrella of the disclosure.
Figure 13:
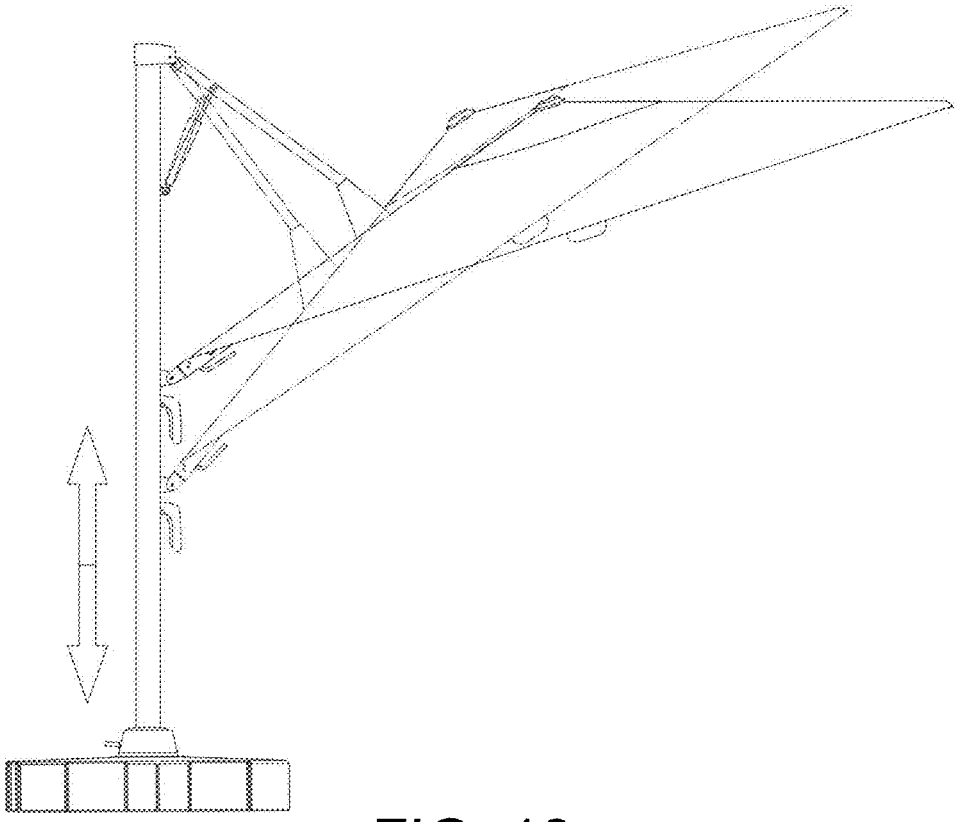
FIG. 13 is a schematic diagram of a vertical angle adjustment change of the whole umbrella of the disclosure.
Figure 14:
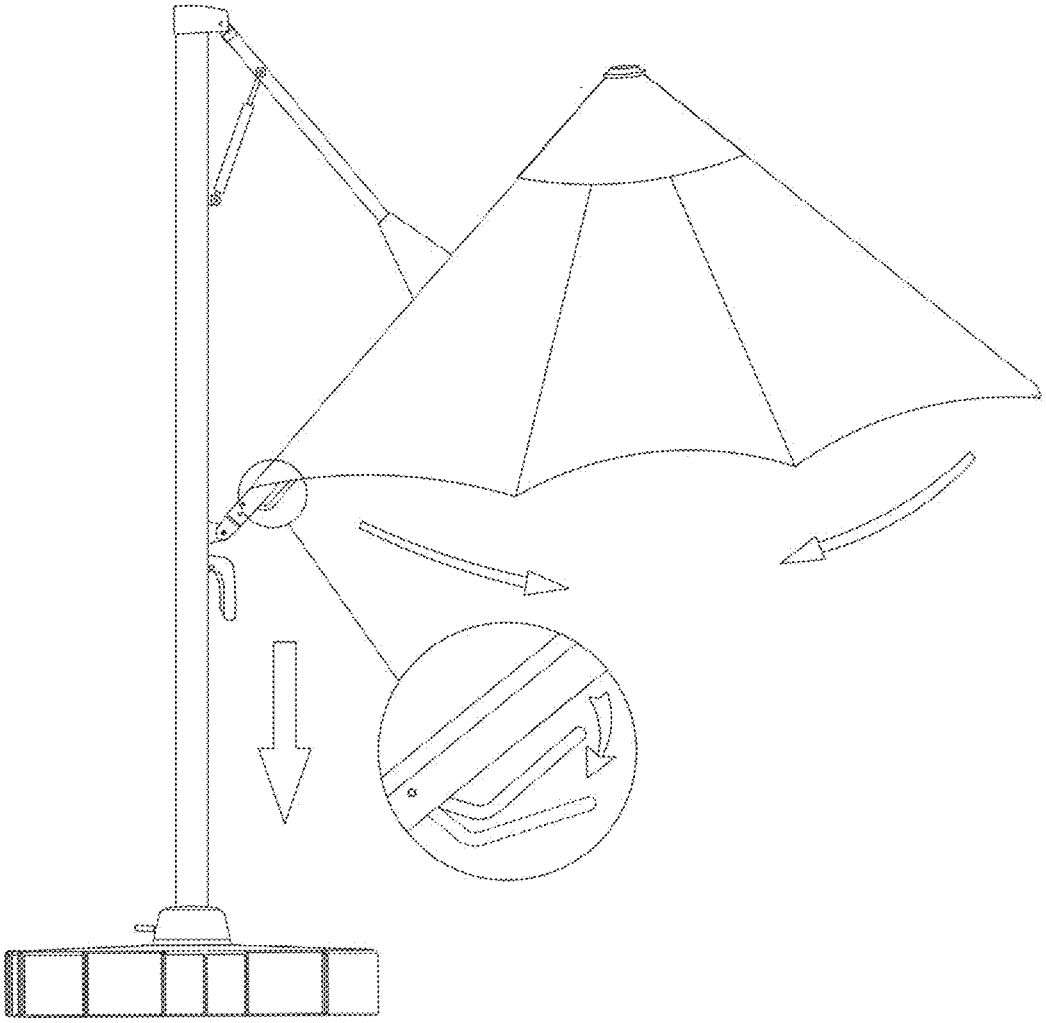
FIG. 14 is a structural schematic diagram of umbrella folding of the whole umbrella of the disclosure.

Referring to FIG. 1 and FIG. 14, the disclosure discloses an outdoor Roman umbrella with an umbrella opening and closing structure, including an umbrella post 100 and an umbrella body 400, where the umbrella post 100 is located at one side of the umbrella body 400, the umbrella body 400 usually includes an upper umbrella disc 410, a lower umbrella disc 420, a plurality of long umbrella ribs 430 hinged and matched with the upper umbrella disc 410, and a plurality of short umbrella ribs 440 hinged and matched with the lower umbrella disc 420, an end of each short rib 440 is usually hinged with the corresponding long umbrella rib 430, the umbrella post 100 is provided with a slider assembly 700 that moves up and down along the umbrella post 100, the slider assembly 700 is hinged and matched with the cantilever 200, the slider assembly 700 includes a sliding seat 710, a cantilever hinged seat 720 and a slider locking member 730, the umbrella post 100 is provided with a sliding groove 110, the sliding seat 710 is configured to be matched with the sliding groove 110 and can move up and down along the sliding groove 110, the cantilever 200 hinged seat is located at an upper part of the sliding seat 710, the cantilever hinged seat 720 is configured to be hinged and matched with an end of the cantilever 200, the slider locking member 730 is used for enabling the sliding assembly 700 to stop at any height of the umbrella post 100, the slider locking member 730 includes a handle 731, a trigger 732 and a lock pin 733, and lock teeth 120 or lock catches configured to be locked with the lock pin 733 are disposed in the sliding groove 110; the trigger 732 can drive the lock pin 733 to be separated from or locked with the lock tooth 120 or a lock hole; this structure is a common structure among Roman umbrella armrest housing structures, which is a common knowledge to those skilled in the art; usually, the lock pin 733 is also equipped with a reset spring element to realize the reset of the lock pin 733; and after a user drives the lock pin 733 to be separated from the lock tooth 120 or the lock hole through the trigger 732, the user can drive the whole slider assembly 700 to move along the umbrella post 100 by pushing the handle 731.

In a specific structure, the other end of the cantilever 200 is configured to be matched with the umbrella body 400, specifically, one end of the cantilever 200 is configured to be hinged and matched with the upper umbrella disc 410 of the umbrella body 400, preferably hinged and matched with the upper umbrella disc 410 through a cantilever joint sleeve 210, which the cantilever joint sleeve 210 is located at the end of the cantilever 200.

In a specific structure, the outdoor Roman umbrella further includes a diagonal draw bar assembly 300, where the diagonal draw bar assembly 300 includes a first diagonal draw bar unit 310, a second diagonal draw bar unit 320, and a receiving seat 330, one end of the first diagonal draw bar unit 310 is hinged and matched with the cantilever 200, the receiving seat 330 is hinged and matched with the cantilever 200, one end of the second diagonal draw bar unit 320 is fixedly matched with the receiving seat 330, the other end of the second diagonal draw bar unit 320 is configured to be mounted with the umbrella body 400 in a matched manner, usually the other end of the second diagonal draw bar unit 320 is hinged and matched with the lower umbrella disc 420 of the umbrella body 400; in a preferred structure, a diagonal draw bar joint sleeve is usually provided to facilitate hinged mounting with the lower umbrella disc 420; the receiving seat 330 is provided with a limiting part 333, and the first diagonal draw bar unit 310 can be folded unidirectionally relative to the second diagonal draw bar unit 320; when the diagonal draw bar assembly 300 is in a straight-bar state, the diagonal draw bar assembly 300 and the cantilever 200 are matched in a crossed manner, specifically in an X-shaped structure, and with upward movement of the slider assembly 700, the diagonal draw bar assembly 300 and the cantilever 200 are deformed in a crossed manner and the umbrella body 400 is driven to open; with the optimization of the structural design, the opening of the umbrella body 400 can be completed by directly pushing the slider assembly 700 without pulling an umbrella rope by the handle, which simplifies operation steps of opening the umbrella body 400.

In a specific structure, the first diagonal draw bar unit 310 includes two first diagonal draw bar bodies 311 arranged in parallel at an interval, the receiving seat 330 includes two receiving seat units 331, the two receiving seat units 331 are respectively disposed on two sides of the cantilever 200, the other end of a single first diagonal draw bar body 311 is hinged and matched with the corresponding receiving seat unit 331, the second diagonal draw bar unit 320 includes two second diagonal draw bar bodies 321 arranged in parallel at an interval, and an end of a single second diagonal draw bar body 321 is configured to be mounted with the corresponding receiving seat unit 331 in a matched manner; a gap is formed between two first diagonal draw bar bodies 311 and a gap is formed between two second diagonal draw bar bodies 321, so that the cantilever 200 can move in the gap. In other preferred embodiments, the receiving seat units 331 are extended, two ends of the two receiving seat units 331 are respectively matched with the first diagonal draw bar unit 310 and the second diagonal draw bar unit 320 through butt joint sleeves. In this embodiment, the first diagonal draw bar unit 310 and the second diagonal draw bar unit 320 can be in a single-rod structure, and the cantilever 200 is convenient to deform by increasing a gap space between the receiving seat units 331. In a specific structure, usually a hinged lifting lug is additionally disposed in the receiving seat unit 331 to be hinged and matched with the first inclined member unit 310.

In combination with the described above, the receiving seat unit 331 is internally provided with an embedding groove 332, the limiting part 333 is disposed at a bottom of the embedding groove 332, an end of the first diagonal draw bar body 311 is hinged and matched with two side walls of the embedding groove 332 through a hinge shaft and the first diagonal draw bar body is able to be flexibly folded along an opening direction of the embedding groove 332; one end of the second diagonal draw bar body 321 is partially embedded into the embedding groove 332, and is fixedly mounted with the side walls of the embedding groove 332 through a fastener; one end of each of the two first diagonal draw bar bodies 331 is hinged and matched with a top seat 101 separately, the top seat 101 is disposed at a top end of the umbrella post 100, the other ends of the two second diagonal draw bar bodies 321 are hinged and matched with the lower umbrella disc 420; in a specific operation process, when the umbrella body 400 is in the folded state, the diagonal draw bar assembly 300 is usually in the straight-bar state, in which the first diagonal draw bar bodies 331 are completely embedded into the embedding grooves 332 and push against the limiting parts 333; the second diagonal draw bar unit 320 is in a downward state and limited by gravity, and the receiving seat units 331 are subjected to a downward force of the second diagonal draw bar bodies 321 all the time, so that docking positions of the receiving seat units 331 and the first diagonal draw bar bodies 311 are in an upward stressed state all the time, the limiting parts 333 are attached to the side walls of the first diagonal draw bar bodies 311 all the time, the diagonal draw bar assembly 300 is in the straight-bar state, and the diagonal draw bar assembly 300 and the cantilever 200 form a cross structure, thereby opening the umbrella body 400 by moving the sliding assembly 700.

In combination with the described above, the umbrella body 400 is internally provided with a locking mechanism 600, and when the umbrella body 400 is completely opened, the locking mechanism 600 completes the locking, so that the umbrella body 400 is in an open state all the time, and at this time, with the sliding assembly 700 moving along the umbrella post 100, an angle of the umbrella body 400 is driven to be adjusted, the first diagonal draw bar unit 310 is folded relative to the second diagonal draw bar unit 320, the first diagonal draw bar bodies 311 are disengaged from the embedding grooves, so that the folding is realized; as the sliding assembly 700 moves down along the umbrella post 100, an included angle between the first diagonal draw bar unit 310 and the cantilever 200 gradually increases, while an included angle between the second diagonal draw bar unit 320 and the cantilever 200 remains unchanged, so that an angle of the umbrella body 400 can be adjusted in a vertical direction.

In a specific structure, the locking mechanism 600 includes an operating member 610, a locking pull rope 620, a first locking member 630, and a second locking member 640, one end of the locking pull rope 620 is matched with the operating member 610 and the other end thereof is matched with the first locking member 630; when the first locking member 630 is locked with the second locking member 640, the locking pull rope 620 is driven by operating the operating member 610, and the locking pull rope 620 drives the first locking member 610 to move to be separated from the second locking member 640, so that the locking mechanism 600 is unlocked; and when the umbrella body 400 needs to be folded, the umbrella body 400 can be initially opened or hovered to stop at any height of the umbrella post 100, and the first locking member 630 and the second locking member 640 can be separated by using the operating member 610 to drive the locking pull rope 620 to be relaxed or tightened.

In one preferred embodiment, the end of the cantilever 200 is hinged and matched with the upper umbrella disc 410 through the cantilever joint sleeve 210, the first locking member 630 is mounted in the upper umbrella disc 410 or the cantilever joint sleeve 210, the first locking member 630 includes a lock rope part 631, a hinge part 632, and a hook part 633, the hinge part 632 is configured to be hinged and matched with the upper umbrella disc 410 or the cantilever joint sleeve 210 and is provided with a reset spring 634, the lock rope part 631 is configured to be fixedly matched with the locking pull rope 620, and the hinge part 633 is configured to be hooked and locked with the second locking member 640; where, the lock rope part 631 can move freely with the loosening of the locking pull rope 620, and, combined with the reset spring 634, can drive the hook part 633 to move outward by the reset spring 634, so that the hook part 633 is disengaged from the second locking member 640. In other embodiments, a position of the reset spring is changed, the lock rope part 631 and the hook part 633 are on the same side, and by tightening the locking pull rope 620, the hook part 633 can be completely disengaged from the second locking member 640.

In combination with the described above, the upper umbrella disc 410 or the cantilever joint sleeve 210 is provided with an accommodating cavity, the first locking member 630 is located in the accommodating cavity, and a position locking hole 411 is formed in a bottom of the accommodating cavity; the second locking member 640 includes a lock hook part 641 and a connecting rod 642, the lock hook part 641 is located at an end of the connecting rod 642, and the connecting rod 642 extends downwards to be fixedly matched with the lower umbrella disc 420; when the umbrella body 400 is opened, the lock hook part 641 enters along the position locking hole 411 and is hooked and locked with the hook part 633; where, the position locking hole 411 preferably adopts a flared hole structure, which is convenient for the lock hook part 641 to enter.

In one preferred embodiment, the operating member 610 is disposed on the cantilever 200, which is convenient for the user to operate.

In one preferred embodiment, the operating member 610 is disposed on the slider assembly 700, which is convenient for the user to operate.

In one preferred embodiment, the operating member 610 is disposed on the umbrella post 100, which is convenient for the user to operate.

In combination with any of the above-described embodiments, the outdoor Roman umbrella further includes an auxiliary driving member 500, where one end of the auxiliary driving member 500 is hinged on the umbrella post 100 through a first mounting seat, and the other end thereof is hinged and matched with the first diagonal draw bar unit 310 through a second mounting seat; the auxiliary driving member 500 preferably adopts a gas spring, which facilitates reducing upward movement resistance of the sliding assembly 700 and improving the operation convenience.

In combination with any of the above-described embodiments, the outdoor Roman umbrella further includes a rotating base 800, and a bottom of the umbrella post 100 is configured to be matched with the rotating base 800, and can be horizontally rotated by the rotating base 800; the rotating base 800 includes a rotating base body 810 and a foot tube 820, the foot tube 820 is sleeved with the umbrella post 100, a handwheel locking member 830 is disposed between the umbrella post 100 and the foot tube 820, the umbrella post 100 can rotate with the foot tube 820, the rotating base 800 adopts a rotating base commonly used in an existing Roman umbrella, which is usually divided into an upper disc and a lower disc that can rotate through bearings and other components. The outdoor Roman umbrella can also be combined with a structure such as a lock tooth disc.

Preferably, a lower part of the rotating base 800 is matched with a counterweight base 900.

According to the disclosure, by utilizing the crossed combination of the diagonal draw bar assembly and the cantilever, the umbrella body can be opened by directly pushing the slider assembly, and a stable unfolded state of the umbrella body can be realized in combination with the locking mechanism, thus improving the stability of the umbrella body; in combination with the locked umbrella body, as the sliding block assembly moves along the umbrella post, the umbrella body can be driven to realize multi-angle inclination adjustment in the vertical direction; generally speaking, the disclosure has the characteristics of convenient operation, stable umbrella body and various adjustment angles.

The described above are only preferred embodiments of the disclosure, and is not intended to limit the disclosure in any form. Any simple modification, equivalent change or modification of the above embodiments according to the technical principles of the disclosure still falls within the scope of the technical solutions of the disclosure.

By adopting crossed combination, the umbrella body can be opened by directly pushing a slider assembly, and the umbrella body can be in a stable unfolded state by combining with a locking mechanism, so that the stability of the umbrella body is improved, and the outdoor Roman umbrella has the characteristics of convenient operation and various adjustment angles.

Compared with the prior art, the disclosure has the following beneficial effects: according to the disclosure, by utilizing the crossed combination of the diagonal draw bar assembly and the cantilever, the umbrella body can be opened by directly pushing the slider assembly, and a stable unfolded state of the umbrella body can be realized in combination with the locking mechanism, thus improving the stability of the umbrella body; in combination with the locked umbrella body, as the sliding block assembly moves along the umbrella post, the umbrella body can be driven to realize multi-angle inclination adjustment in the vertical direction; generally speaking, the disclosure has the characteristics of convenient operation, stable umbrella body and various adjustment angles.

The characteristics of the disclosure can be clearly understood with reference to the attached drawings of the present application and the detailed description of the following preferred embodiments.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An outdoor Roman umbrella with a umbrella opening and closing structure, the outdoor Roman umbrella comprising an umbrella post and an umbrella body, wherein the umbrella post is provided with a slider assembly that moves up and down along the umbrella post, the slider assembly is hinged and matched with a cantilever, and the other end of the cantilever is configured to be matched with the umbrella body; the outdoor Roman umbrella further comprising a diagonal draw bar assembly, wherein the diagonal draw bar assembly comprises a first diagonal draw bar unit, a second diagonal draw bar unit, and a receiving seat, one end of the first diagonal draw bar unit is hinged and matched with the cantilever, the receiving seat is hinged and matched with the cantilever, one end of the second diagonal draw bar unit is fixedly matched with the receiving seat, the other end of the second diagonal draw bar unit is configured to be mounted with the umbrella body in a matched manner, the receiving seat is provided with a limiting part, and the first diagonal draw bar unit is capable of being folded unidirectionally relative to the second diagonal draw bar unit; when the diagonal draw bar assembly is in a straight-bar state, the diagonal draw bar assembly and the cantilever are matched in a crossed manner, and with the slider assembly moving upward, the diagonal draw bar assembly and the cantilever are deformed in a crossed manner and the umbrella body is driven to be opened; and the umbrella body is internally provided with a locking mechanism, and when the umbrella body is completely opened, the locking mechanism completes locking, so that the umbrella body is in an open state all the time, and with the sliding assembly moving along the umbrella post, an angle of the umbrella body is driven to be adjusted, wherein the first diagonal draw bar unit comprises two first diagonal draw bar bodies arranged in parallel at an interval, the second diagonal draw bar unit comprises two second diagonal draw bar bodies arranged in parallel at an interval, the receiving seat comprises a first receiving seat unit and a second receiving seat unit respectively disposed on two sides of the cantilever, the other end of one of the first diagonal draw bar bodies is hinged and matched with the first receiving seat unit, and an end of one of the second diagonal draw bar bodies is configured to be mounted with the first receiving seat unit in a matched manner, the other end of the other one of the first diagonal draw bar bodies is hinged and matched with the second receiving seat unit, and an end of the other one of the second diagonal draw bar bodies is configured to be mounted with the second receiving seat unit in a matched manner, wherein each of the first and second receiving seat units is internally provided with an embedding groove, the limiting part is disposed at a bottom of the embedding groove, an end of the first diagonal draw bar body is hinged and matched with two side walls of the embedding groove through a hinge shaft and the first diagonal draw bar body is able to be flexibly folded along an opening direction of the embedding groove.

2. The outdoor Roman umbrella with an umbrella opening and closing structure according to claim 1, wherein one end of the second diagonal draw bar body is partially embedded into the embedding groove, and is fixedly mounted with the side walls of the embedding groove through a fastener; one end of each of the two first diagonal draw bar bodies is hinged and matched with a top seat separately, the top seat is disposed at a top end of the umbrella post, one end of the cantilever is configured to be hinged and matched with an upper umbrella disc, and the other ends of the two second diagonal draw bar bodies are configured to be hinged and matched with a lower umbrella disc.

3. The outdoor Roman umbrella with an umbrella opening and closing structure according to claim 2, further comprising an auxiliary driving member, wherein one end of the auxiliary driving member is hinged on the umbrella post through a first mounting seat, and the other end of the auxiliary driving member is hinged and matched with the first diagonal draw bar unit through a second mounting seat.

4. The outdoor Roman umbrella with an umbrella opening and closing structure according to claim 2, wherein the locking mechanism comprises an operating member, a locking pull rope, a first locking member, and a second locking member, one end of the locking pull rope is matched with the operating member and the other end of the locking pull rope is matched with the first locking member; and when the first locking member is locked with the second locking member, the locking pull rope is driven by operating the operating member, and the locking pull rope drives the first locking member to move to be separated from the second locking member, so that the locking mechanism is unlocked.

5. The outdoor Roman umbrella with an umbrella opening and closing structure according to claim 4, wherein one end of the cantilever is hinged and matched with the upper umbrella disc through a cantilever joint sleeve, the first locking member is mounted in the upper umbrella disc or the cantilever joint sleeve, the first locking member comprises a lock rope part, a hinge part, and a hook part, the hinge part is configured to be hinged and matched with the upper umbrella disc or the cantilever joint sleeve and is provided with a reset spring, the lock rope part is configured to be fixedly matched with the locking pull rope, and the hinge part is configured to be hooked and locked with the second locking member.

6. The outdoor Roman umbrella with an umbrella opening and closing structure according to claim 5, wherein the upper umbrella disc or the cantilever joint sleeve is provided with an accommodating cavity, the first locking member is located in the accommodating cavity, and a position locking hole is formed in a bottom of the accommodating cavity.

7. The outdoor Roman umbrella with an umbrella opening and closing structure according to claim 6, wherein the second locking member comprises a lock hook part and a connecting rod, the lock hook part is located at an end of the connecting rod, and the connecting rod extends downwards to be fixedly matched with the lower umbrella disc; and when the umbrella body is opened, the lock hook part enters along the position locking hole and is hooked and locked with the hook part.

8. The outdoor Roman umbrella with an umbrella opening and closing structure according to claim 7, wherein the operating member is disposed on the cantilever or the slider assembly or the umbrella post.

9. The outdoor Roman umbrella with an umbrella opening and closing structure according to claim 8, wherein the outdoor Roman umbrella further comprises a rotating base, and a bottom of the umbrella post is configured to be matched with the rotating base, and is able to be horizontally rotated by the rotating base.

10. The outdoor Roman umbrella with an umbrella opening and closing structure according to claim 9, wherein the rotating base includes a rotating base body and a foot tube, the foot tube is sleeved with the umbrella post, a handwheel locking member is disposed between the umbrella post and the foot tube, and the umbrella post is able to rotate with the foot tube.

11. The outdoor Roman umbrella with an umbrella opening and closing structure according to claim 10, wherein a lower part of the rotating base is matched with a counterweight base.

12. The outdoor Roman umbrella with an umbrella opening and closing structure according to claim 1, wherein the slider assembly includes a sliding seat, a cantilever hinged seat and a slider locking member, the umbrella post is provided with a sliding groove, the sliding seat is configured to be matched with the sliding groove and is able to move up and down along the sliding groove, the cantilever hinged seat is located at an upper part of the sliding seat, the cantilever hinged seat is configured to be hinged and matched with an end of the cantilever, and the slider locking member is configured for enabling the sliding assembly to stop at any height of the umbrella post.

13. The outdoor Roman umbrella with an umbrella opening and closing structure according to claim 12, wherein the slider locking member includes a handle, a trigger and a lock pin, and lock teeth or lock catches configured to be locked with the lock pin are disposed in the sliding groove.

* * * * *